United States Patent [19]

Arena

[11] 4,037,632

[45] July 26, 1977

[54] NAIL HOLDING DEVICE

[76] Inventor: Thomas Arena, 1905 Allison Drive, Bellmore, N.Y. 11710

[21] Appl. No.: 711,427

[22] Filed: Aug. 3, 1976

[51] Int. Cl.[2] ..... B25C 3/00

[52] U.S. Cl. ..... 145/46

[58] Field of Search ..... 145/46, 30 A

[56] References Cited

U.S. PATENT DOCUMENTS

| | | | |
|---|---|---|---|
| 29,760 | 8/1860 | Boeklen | 145/30 A |
| 2,491,860 | 12/1949 | Ingraham | 145/46 |
| 2,635,237 | 4/1953 | Langer | 145/46 |
| 2,648,066 | 8/1953 | Ingraham | 145/46 |

*Primary Examiner*—James L. Jones, Jr.
*Assistant Examiner*—J. T. Zatarga
*Attorney, Agent, or Firm*—Allen D. Brufsky

[57] ABSTRACT

A nail-holding device comprises a magnetic block having two sides meeting at a right angle. When the block is positioned with one of such sides against a working surface, the other side is perpendicular to such surface. A longitudinally extending groove is provided in such other side in perpendicular relation to the working surface. A matnetizable nail placed in such groove is retained perpendicularly to such surface and can thereby be initially driven straight into the surface.

9 Claims, 3 Drawing Figures

FIG. 1
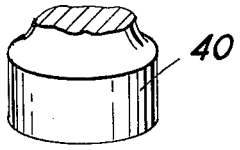
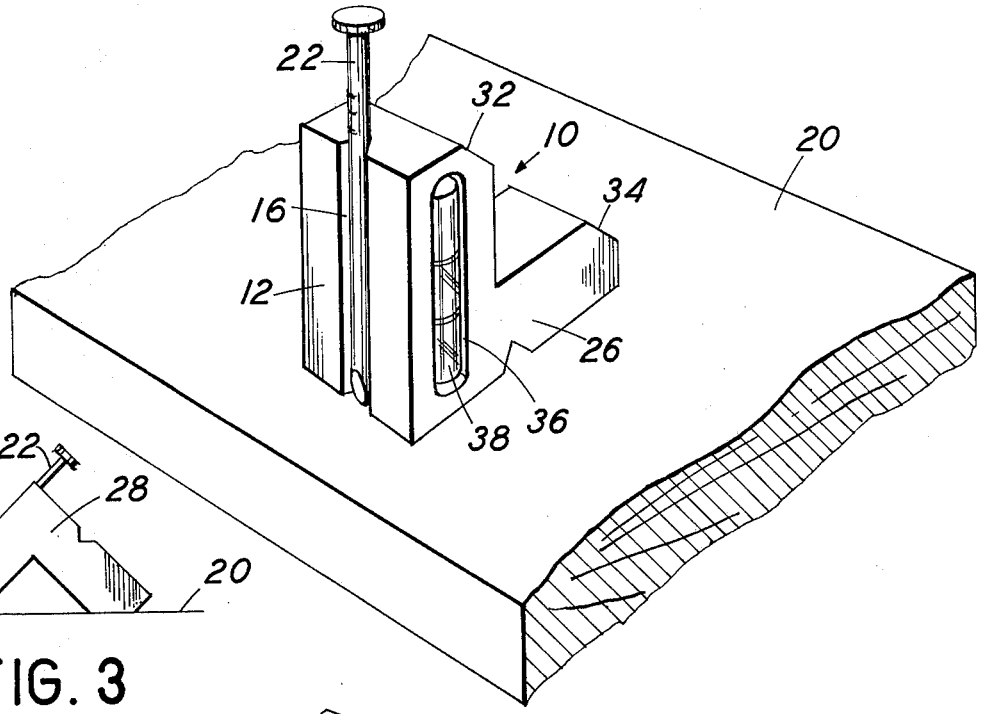
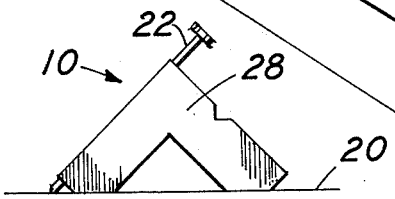
FIG. 3
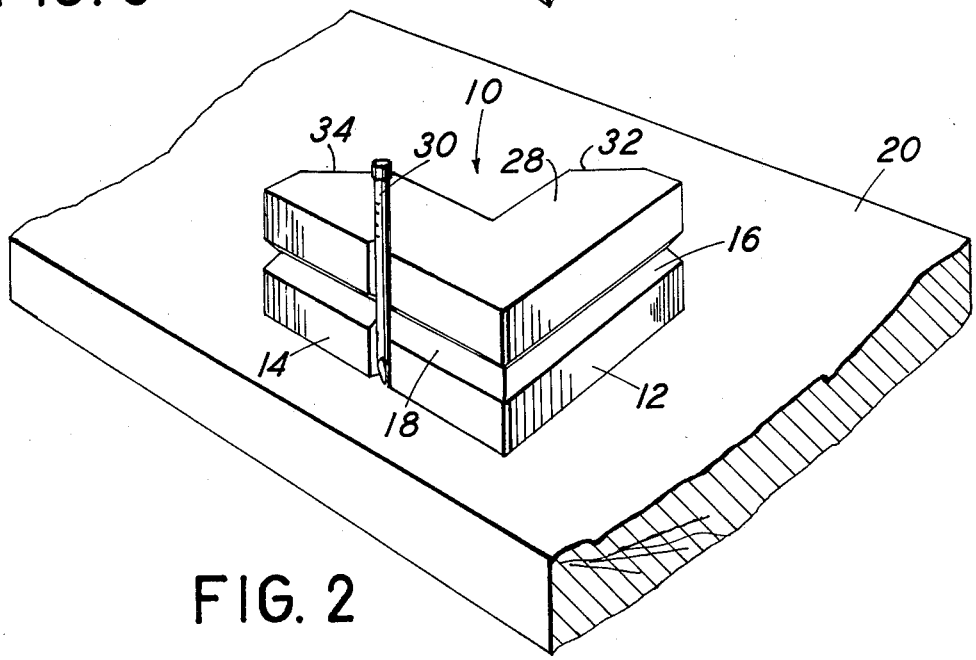
FIG. 2

NAIL HOLDING DEVICE

BACKGROUND OF THE INVENTION

This invention relates to a nail-holding device and is particularly concerned with the provision of such a device that will readily enable the driving of a nail straight into a working surface to be effected.

In the driving of a nail into a working surface, it is frequently desired to have the nail enter the working surface perpendicularly or straight with respect thereto. To do so by hand requires a certain amount of skill, which the average person rarely possesses. Moreover, even with such skill, one cannot be sure that every nail or almost every nail will enter perpendicularly into the working surface.

To assure a greater degree of accuracy in this regard, various devices have been heretofore proposed for holding or positioning a nail with respect to a working surface. Many of these devices merely provide an arrangement for holding the nail so that it can be suitably struck by a hammer and still require that the proper positioning of the nail with respect to the working surface be achieved by hand.

Other such devices are so constructed as to enable a nail to be driven straight into a working surface. These devices, however, are relatively complicated in design and/or use and are generally less than completely satisfactory.

SUMMARY OF THE INVENTION

I have now found that the indicated disadvantages can be substantially avoided by means of the present invention, which provides a relatively simple device for enabling a nail to be accurately driven perpendicularly into a working surface.

In accordance with the invention, I provide a nail-holding device basically comprising a magnetic block having two sides meeting at a right angle. When this block is positioned with one such side against the working surface, the other such side is automatically arranged perpendicularly with respect to such surface. A groove extends longitudinally the full length of such other side in such manner that, when the block has been positioned as indicated, the groove extends perpendicularly with respect to the working surface. A magnetizable nail placed in this groove is thereby retained therein perpendicularly with respect to the working surface and can thus be very simply initially driven straight into such surface. The length of such other side must, of course, be less than the length of the nail but should be sufficiently long for adequate retention of the nail.

BRIEF DESCRIPTION OF THE DRAWINGS

The invention will now be described in detail in connection with the accompanying drawings, in which:

FIG. 1 is a perspective view of the present nail-holding device in one position on a working surface;

FIG. 2 is a perspective view of such nail-holding device in another position on the working surface; and FIG. 3 is an elevational view of an alternative manner of utilizing the present device.

DESCRIPTION OF THE PREFERRED EMBODIMENTS

A shown in FIGS. 1 and 2, the nail-holding device of the invention comprises a block 10 or similar body having two sides 12 and 14 meeting at a right angle. Side 12 is provided with a groove 16 which extends longitudinally the full length of such side. Preferably, side 14 is provided with a similar longitudinally extending groove 18.

When it is desired to initially drive a nail into the working surface 20, the block 10 is positioned, as indicated in FIG. 1, so that its side 14 is against the working surface. In such manner the side 12 is necessarily arranged perpendicularly with respect to working surface 20, the groove 16 being so formed in side 12 that it also extends perpendicularly with respect to such working surface.

A nail 22, which is made of any suitable magnetizable material such as iron or steel, is then inserted into groove 16, where it is retained by means of magnetic attraction by block 10, which is formed of any suitable magnetic material such as magnetized steel. The nail 22 is thus retained perpendicularly with respect to the working surface 20 and can be initially driven straight thereinto. As will be appreciated, the length of side 12 must be less than the length of the nail but should be sufficiently long so that the nail is adequately retained in groove 16.

Groove 18 in side 14 is formed in the same manner as groove 16 in side 12. Advantageously, however, sides 12 and 14 have different lengths so that nails of different sizes can be accommodated by the same device. It will be understood, of course, that several different blocks 10 can also be provided, as in a set, in the event that nails of varying lengths are to be utilized.

Grooves 16 and 18 may have any desired cross-section. Preferably, however, such grooves are V-shaped in order to readily accommodate nails of varying diameter while still exerting adequate magnetic attraction on the same.

More than one longitudinally extending groove may be provided in each of sides 12 and 14 if desirable or necessary. Ordinarily, however, a single such groove in each side is all that will be required.

Block 10 may have any shape provided that it is formed with sides 12 and 14 in the indicated right-angled relationship. Usually, however, block 10 will have a general configuration such as shown in FIGS. 1 and 2, in which parallel spaced faces 26 and 28 extend perpendicularly from sides 12 and 14. In such manner the block can be positioned on the working surface so that sides 12 and 14 are arranged perpendicularly thereto.

Such construction is particularly useful when it is desired to initially drive a small nail or brad into the working surface. In such case there is provided, as in side 14, a groove extending transversely the full width of such side and so formed that it extends perpendicularly with respect to the working surface when the block is positioned thereon as indicated in the previous paragraph. Such transverse groove is then adapted to retain a nail or brad 30 perpendicular with respect to the working surface.

Block 10 may be one solid piece; or, as shown in FIGS. 1 and 2, it may advantageously be L-shaped to make it less bulky. If desired, it may also be only locally magnetized as in those portions including sides 12 and 14 and their respective grooves.

It is a feature of the invention that the respective outer ends of sides 12 and 14 can be beveled as desired at 32 and 34. In this way there is in effect provided a third side respectively meeting such outer ends at an acute angle. When the block 10 is then positioned with such third side against the working surface, as shown in FIG. 3, nail 22 can be initially driven into such surface at a slant, in effect, toe-nailed.

To facilitate its handling, block 10 may be provided with a recess such as 36 in either or both of faces 26 and 28 so that the block can be appropriately gripped by the fingers. Moreover, a level-indicating device 38 may be positioned in one of such recesses is that the working surface can be leveled as required.

In use, once the nail 22, for example, has been properly placed in groove 16, such nail is initially driven into the working surface by means of the hammer 40. Thereafter, the block 10 is removed from nail 22; and driving of the latter into the working surface is completed as desired.

An incidental advantage of the present device is that the right-angle portion formed by sides 12 and 14 can be utilized to check the squareness of corners.

It is to be understood that the term "nail" as used herein includes not only nails but brads, tacks, and similar types of fasteners.

I claim:

1. A nail holding device comprising a block of magnetic material formed with two sides meeting at a right angle whereby, when said block is positioned with one of said sides against a working surface, the other of said sides is arranged prependicularly with respect to said working surface; and a groove extending longitudinally the full length of said other side and so formed in said other side that, when the block is positioned as indicated, said groove extends perpendicularly with respect to said working surface whereby, when a nail made of a magnetizable material is placed in said groove, said nail is retained perpendicularly with repsect to said working surface, the length of said other side being less than the length of said nail but sufficiently long to adequately retain the nail so that initial driving of the nail straight into the working surface can be effected, said block further provided with a third side respectively meeting the outer ends of said two sides at an acute angle whereby, when said block is positioned with said third side against the working surface, initial driving of a nail retained in the groove in said other side can be effected at an angle.

2. A device according to claim 1, in which said longitudinal groove is V-shaped.

3. A device according to claim 1, in which said one side is provided with a longitudinally extending groove in the same manner as said other side.

4. A device according to claim 3, in which the length of said one side differs from the length of said other side.

5. A device according to claim 1, in which said block is also formed with parallel spaced faces extending perpendicularly from said two sides whereby said block can be positioned on the working surface with both of said sides arranged perpendicularly with respect thereto; and a groove is so formed in at least one of said sides and extends transversely the full width of said side that, when the block is positioned as indicated above, said transverse groove extends perpendicularly with respect to said working surface and is adapted to retain a nail made of a magnetizable material perpendicular with respect to said working surface.

6. A device according to claim 5, in which a recess is provided in one or both of said faces for finger-gripping of the block.

7. A device according to claim 5, in which a recess is provided in one of said faces, and a level-indicator is positioned in said recess.

8. A device according to claim 1, in which said block is L-shaped.

9. A device according to claim 1, in which said block is made of magnetized steel.

* * * * *